United States Patent [19]

Combs

[11] Patent Number: 5,044,191

[45] Date of Patent: Sep. 3, 1991

[54] FRAME PULLING BAR AND TOOL SYSTEM

[76] Inventor: Paul D. Combs, 1268 Oakfield Dr., North, Columbus, Ohio 43229

[21] Appl. No.: 497,922

[22] Filed: Mar. 21, 1990

[51] Int. Cl.[5] ..... B21D 1/12

[52] U.S. Cl. ..... 72/422; 72/705

[58] Field of Search ..... 72/308, 422, 457, 479, 72/705

[56] References Cited

U.S. PATENT DOCUMENTS

| | | | |
|---|---|---|---|
| 3,108,629 | 10/1963 | Jenkins | 72/705 |
| 3,111,159 | 11/1963 | Jenkins | 72/705 |
| 3,338,086 | 8/1967 | Hunter | 72/457 |
| 3,631,705 | 1/1972 | McCaffrey | 72/705 |
| 3,760,625 | 9/1973 | Archambault | 72/705 |
| 3,955,249 | 5/1976 | Shiozaki | 72/705 |
| 4,248,078 | 2/1981 | Russo | 72/705 |
| 4,510,790 | 4/1985 | are | 72/705 |
| 4,519,236 | 5/1985 | Celette | 72/705 |
| 4,770,025 | 9/1988 | Graf | 72/705 |
| 4,916,793 | 4/1990 | Kuhn | 72/705 |

OTHER PUBLICATIONS

Newspaper, "Automotive Body Repair News", vol. 29, No. 1, pp. 12, 28, and 30, Jan., 1990.

*Primary Examiner*—Lowell A. Larson

*Attorney, Agent, or Firm*—Watkins, Dunbar & Pollick

[57] ABSTRACT

A frame pulling bar and tool system for use in clamping to the body of an automobile or other vehicle as a means of anchoring pulling devices to the frame or body in the pulling and stretching operations necessary to restore and repair damaged automobile or vehicle bodies. The system includes a clamping bar and a plurality of threaded bolts for engagement in threaded holes in the clamping bar. Auxiliary bars may be included to expand the capability of the systenm.

6 Claims, 2 Drawing Sheets

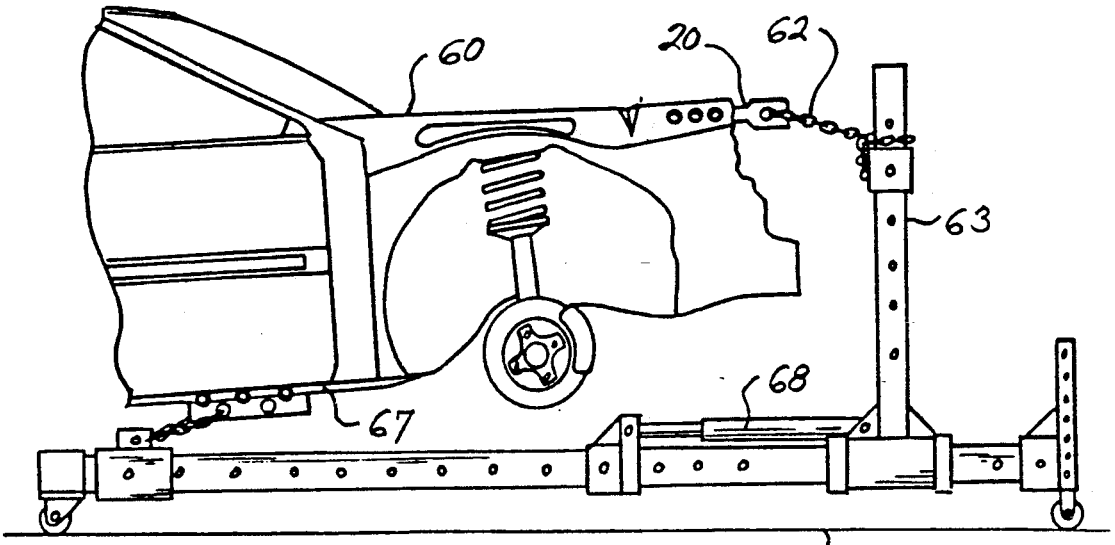
FIG. 4
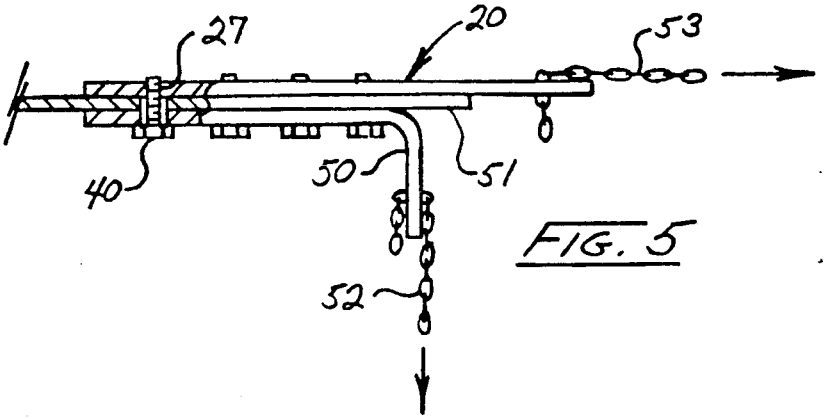
FIG. 5
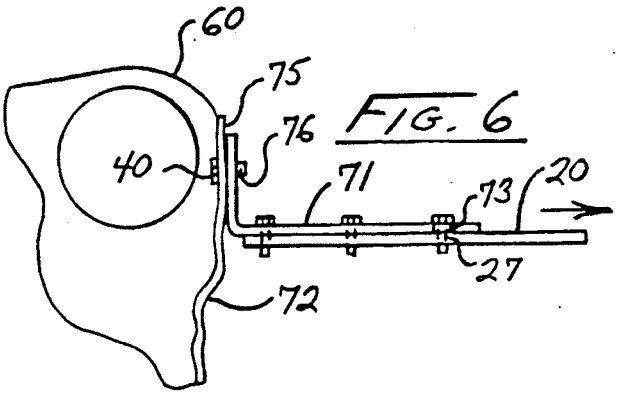
FIG. 6
FIG. 7
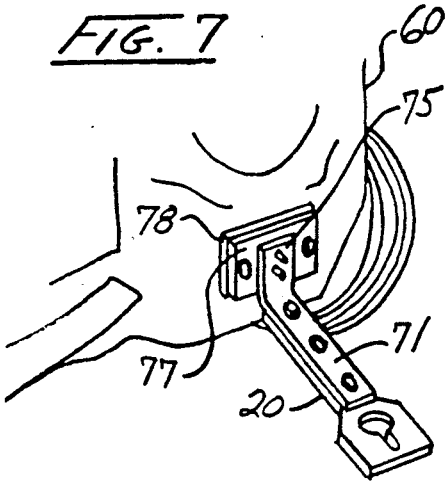

FRAME PULLING BAR AND TOOL SYSTEM

FIELD OF THE INVENTION

This invention relates to pulling bars and tools used in straightening the frames of wrecked and deformed automobile and vehicle bodies. More particularly, it relates to a plurality of tool components constructed to be used together and fitted one to another to provide a system of handling the various problems that are confronted by those engaged in rebuilding and repairing automobile and other vehicle bodies.

BACKGROUND OF THE INVENTION

In the straightening of automobile and vehicle bodies for the repair of wrecked or damaged ones, it is the practice to stretch the bodies back to their original shapes. Many and perhaps most of the automobiles built at this time are of "unibody" construction. In this construction the body acts as the frame to which all of the other components are attached. This is in contrast to previous constructions where vehicles were built on a lateral frame having the components and the body attached thereto. With the present construction it is not possible to straighten the frame and repair the various components while detached from the frame.

In the repair of unibody constructed automobiles, with the body being the frame, it is necessary to bring the body back to it original shape and this is done by pulling the body from various points either simultaneously or singularly. Naturally, very high forces are involved and the present day "body shop" is equipped with various devices capable of bringing these forces to bear at appropriate positions around and on the body.

Practitioners in this field have patented various devices to carry out the purposes described above and these are represented by example in U.S. Pat. No. 4,510,790 Hare. Other examples will be seen in the advertisements found in the Trade Journal "Automotive Body Repair News". The January 1990 issue is cited as an example thereof.

An example of a commonly used pulling device is shown in U.S. Pat. No. 3,108,629 Jenkins in FIG. 1. The device shown therein is commonly called a "Dozer". Probably more body shops use a Dozer in one form or another, in contrast to the more complicated frame machines that are used in the Hare patent and the advertisements of the Trade Journal cited above.

It is also a common practice to provide anchors in the concrete floor of the shop to attach holding chains between some portion of the body and the anchor. At some point in the "stretching" system hydraulic cylinders are provided to exert the forces necessary to stretch the body back to its original shape.

As an adjunct to these systems it is necessary to grip the body at the various points where the forces are to be exerted.

Getting a firm grip on the body sufficient to withstand these high pulling forces is a difficult problem. Various practitioners have provided devices for this purpose.

U.S. Pat. No. 4,770,025 Graf discloses a frame clamp with adjustable jaws, and a bolt with nut.

U.S. Pat. No. 4,519,236 Celette reveals a clamping device which clamps the frame between jaw components 24 and 25.

U.S. Pat. No. 4,248,078 Russo describes an apparatus for clamping a rocker panel and seam section of a unitized automobile body. Bolts and nuts are used.

U.S. Pat. No. 3,955,249 Shiozaki discloses a frame clamp which closes when a wedge is pulled into rocking clamp jaws.

U.S. Pat. No. 3,631,705 McCaffery reveals a device to insert and anchor a wedge clamp bolt in a "blind" box frame. The bolt includes a nut.

U.S. Pat. No. 3,108,629 Jenkins shows a body frame clamp having bolts that are threadedly passed through one side of the clamp to engage and force a frame member against an indent on the other side.

These prior art approaches have not completely satisfied conditions that exist in this practice.

For this reason many practitioners follow the practice of bolting or welding an attachment plate to the body at the position where the pull is to take place. If welding is the method used then the weld, of course, must be removed and this often requires taking out a piece of the frame which must then be replaced with additional welded pieces. This is time consuming and complicated.

If the bolting method is used the common practice is to provide a pull bar having holes therein. The pull bar is placed against the frame and holes matching the pull bar are drilled through the frame. Following this, bolts are placed through the holes and nuts are placed on the opposite side. Placing the nuts on the bolts is very difficult and often very time consuming. There is little space to place the nuts and they are often in places where other parts make it impossible to see the ends of the bolts for the threading process.

This invention is an improvement on the bolting method by providing a series of clamping bars to form a set of tools capable of being used by one person for attachment to the frame.

In the previous method it is necessary that two persons take part in the bolt clamping process. This is because there are three parts to the process i.e., the bolts, the plates, and the nuts requiring three hands. One of the objects of this invention is to provide a system capable of being operated by one person therefore providing time savings and reducing complications of scheduling in the set up operations.

SUMMARY OF THE DISCLOSURE

In summary, this invention is a clamping bar and system for the use thereof with a plurality of bolts. The system is for use in the repair of automobile or other vehicle bodies and/or frames which require pulling and stretching back to their original shape and with which it is necessary to attach powerful pulling devices that are securely clamped to the bodies and frames. The system includes an elongated bar having a clamping portion and an anchor portion. The clamping portion comprises a generally rectangular cross-section with opposing flat sides and connected by opposing edges, the flat sides having a plurality of threaded holes constructed to receive a plurality of matching threaded bolts, the threaded holes being in spaced relation one to the next and aligned with the longitudinal axis of elongation of the bar, the anchoring portion including means to anchor the pulling devices. The system includes a plurality of threaded bolts constructed to threadedly engage in the threaded holes in the clamping bar.

In other aspects, the system includes a plurality of especially configured auxiliary bar members for use in attaching the anchor bar at various places on the body and frame of an automobile or other vehicle.

The foregoing and other advantages of the invention will become apparent from the following disclosure in which the preferred embodiment of the invention is described in detail and illustrated in the accompanying drawings. It is contemplated that variations in procedure, structural features and arrangement of parts may appear to those skilled in the art without departing from the scope or sacrificing any of the advantages of the invention.

BRIEF DESCRIPTION OF THE DRAWINGS

FIG. 4 is a schematic elevational view of the system of this invention in place in assembly with an automobile, and other apparatus with which the invention is used.

FIG. 5 is another embodiment of this invention constructed for a pull in a lateral direction to the longitudinal axis of the clamping bar of the invention.

FIG. 6 is an elevational view of another embodiment of the invention with another form of auxiliary bar.

FIG. 7 is a perspective view of a portion of an automobile body with another embodiment of the invention in place.

DETAILED DESCRIPTION OF THE PREFERRED EMBODIMENT OF THE BEST MODE OF CARRYING OUT THE INVENTION

Figure 1:
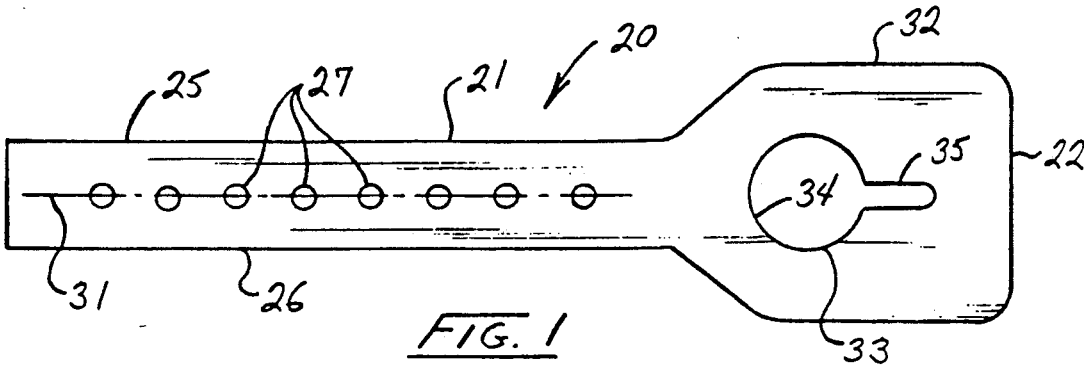
FIG. 1 is a plan view of the clamping bar of this invention.
Figure 2:
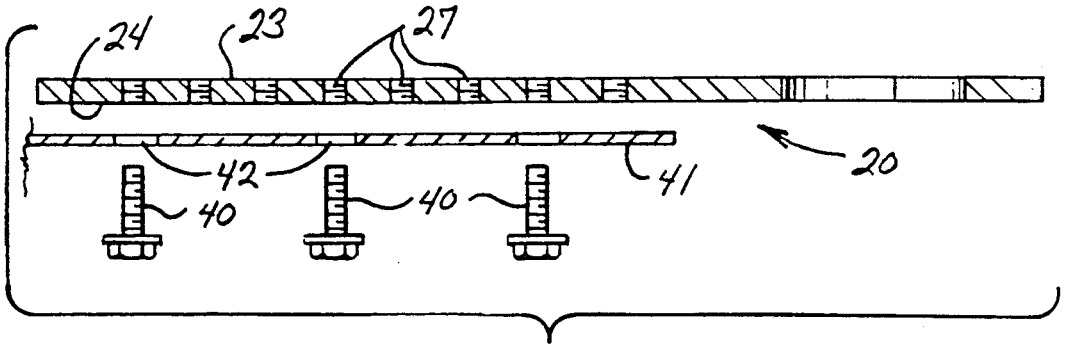
FIG. 2 is an exploded elevational view of a portion of an automobile frame with the clamping bar and bolts in alignment, as used in this invention.

Referring to FIGS. 1 and 2, a clamping bar 20 includes the clamping portion 21 and an anchor portion 22. The clamping portion 21 is generally rectangular in cross-section, and elongated in configuration, having opposite flat sides 23 and 24 connected by opposing edges 25 and 26. A plurality of threaded holes 27 are provided in spaced relation, one to the next, and aligned with the longitudinal axis 31 of elongation of the bar 20.

The anchor portion 32 is preferably bulbous in shape having a width greater than the width of the flat sides of the of the clamping portion 21. While the anchor portion is preferably bulbous in shape because it provides a demarkation between the anchor portion 22 and the clamping portion 21, it need not be larger but could be a general prolongation of the clamping portion.

An anchor means 33 comprises an aperture formed in an enlarged section 34 and a slotted section 35. The enlarged section 34 is constructed of a size to pass through a chain 36 continuously, whereas the slotted section is sized to receive one link of such a chain. By this means, when a chain 36 is used as a pulling device it can be adjustively passed through the holding means 33 to a selected position and then anchored in the slotted section 35.

Referring to FIG. 2, the elongated bar 20 and a plurality of bolts 40 comprise a system used to anchor a portion of a body or frame 41. In operation of the system, enlarged holes 42 are provided through which the bolts 40 are inserted and threadedly engaged in the threaded holes 23. The number of bolts and holes to be used in any specific instance may be varied according to the amount of pulling power expected and the resistance to tearing of the body section 41. It will be apparent that the bolts 40 and clamping bar 20 can be assembled as a system by one person with one hand on the clamping bar 20 and the other hand on a bolt 40.

Figure 3:
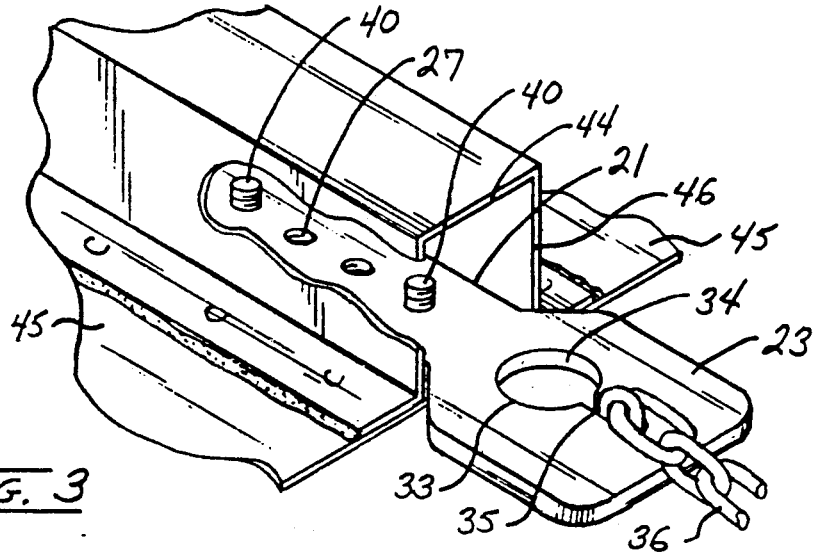
FIG. 3 is a broken out section of a frame rail in a unibody construction with the clamping bar of this invention in place.

Referring to FIG. 3, a typical installation is shown wherein the clamping bar 20 is inserted in a channel 44 of a typical unibody automobile construction. The channel 44 is welded or riveted to a floor panel or lateral member 45 of the automobile body. In the repair of the body it is often necessary to clamp onto the channel portions and pull and stretch the channel 44 back to its original shape and length. In the use of the clamping bar and bolt system of this invention, the clamping bar 20 is inserted within the channel after holes are drilled from below. The operator can hold the clamping bar in place and insert the bolts through the holes and threadedly engage into the bar 20 with one hand on each component, i.e., the clamping bar 20 and the bolt 40. This can be carried out even in the farthermost and deepest most bolt and threaded hole.

One of the important features of this invention is demonstrated, when it is realized that to accomplish this result in the prior art fashion a nut would have to be inserted on top of each bolt 40. At the same time the bolt would have to be held up through the panel 45 and a bar before the nuts are put in place. Thus, it will be seen that three hands are required to accomplish this, which is inefficient and extra time consuming compared to the two hand, one man operation of this invention.

It will be further appreciated that in the prior art in generally accepted present practice many of the bolts and nuts are far removed from the front edge of the channel 44 to a point where it is extremely difficult and sometimes impossible for an operator's hand to reach inside and thread the nut on the bolt. To the contrary, in this invention no inner threading is necessary and the operation is carried out with the two hands of one person i.e., one hand holding the clamping bar 20 and the other hand threading bolts through from below.

Referring to FIG. 5, use of the clamping bar 20 and system of this invention is further enhanced by the provision of a formed auxiliary bar 50 which is held in place against a frame member 51 beneath the clamping bar 20. Bolts 40 are threaded through enlarged holes in the auxiliary bar 50 and the body member 51 and are engaged in the threaded holes 27. In the use of the auxiliary bar 50, a second pulling means such as a chain 52 may be used to exert a lateral force on the body member 51 in addition to the generally longitudinal pull of the pulling device 53 (as shown by the arrows).

Referring to FIG. 4, the body of an automobile 60 with a crushed front end 61 is shown in position to be stretched. A clamping bar 20 of this invention is in place in a channel frame member, such as that shown in FIG. 3. A pulling device such as a chain 62 stretches from the clamping bar 20 to the frame of a Dozer 63. The Dozer 63 rests on the floor 70 and may be anchored by another chain means to the floor at another position (not shown). The other end of the Dozer 63 is anchored to a clamping device which is secured laterally on the side of a frame rail 67 of the automobile 60. When hydraulic fluid under pressure is supplied to a cylinder 68 on the Dozer 63, pulling forces are exerted on the frame and body of the automobile 60.

Referring to FIG. 6, a clamping bar 20 is attached to an auxiliary bar 71 which is bolted to the side of a crushed fender 72 of an automobile 60. The auxiliary bar 71 is provided with unthreaded holes 73 in position to match the threaded holes 27 in the clamping bar 20. An angled portion 75 is provided with a threaded hole 76 into which a bolt 40 is threaded from the other side of the fender 72. By the means shown in FIG. 6, the clamping bar 20 can be used in a system providing for still a further application while being operated by one person.

Referring to FIG. 7, a clamping bar 20 is fastened to an auxiliary bar 71 having an angled portion 75 which is further fastened to an endplate 77 that is bolted to matching endplate 78. The endplate 78 is a weldment on one end of a shock absorber channel commonly found in unibody constructed automobiles. It is often necessary to pull on the stanchion at the end of the channel which houses the shock absorbers that support the bumpers in modern automobile construction. These stanchions are provided with welded endplates 78 to which shock absorber assemblies are bolted. By the means of the auxiliary unit 71 and 77 in combination with the clamping bar 20 it is possible to bolt directly onto the stanchion and pull the shock absorber housing channel into its proper position.

It is herein understood that although the present invention has been specifically disclosed with the preferred embodiments and examples, modifications and variation of the concepts herein disclosed may be resorted to by those skilled in the art. Such modifications and variations are considered to be within the scope of the invention and the appended claims.

I claim:

1. A clamping bar for use in the repair of automobile and vehicle bodies and frames which require pulling and stretching back to their original shape, and with which it is necessary to attach powerful pulling devices that are securely clamped to the bodies and frames, comprising:

(a) an elongated bar including a clamping portion and an anchor portion, with the clamping portion comprising a generally rectangular cross-section with opposing flat sides connected by opposing edges, the flat sides having a plurality of threaded holes constructed to receive a plurality of matching threaded bolts, the threaded holes being in space relation one to the next and aligned with the longitudinal axis of elongation of the bar, and (b) the anchor portion including means to anchor the pulling devices.

2. The clamping bar according to claim 1 wherein the anchor means is an aperture in the form of an enlarged section and a slotted section, and the pulling device is a chain constructed to pass through the enlarged section and anchor in the slotted section.

3. A clamping bar according to claim 1 wherein the anchor portion is enlarged beyond the edges of the clamping portion and is of bulbous shape.

4. A clamping bar system for use in the repair of automobiles and vehicle bodies and frames which require pulling and stretching back to their original shape and with which is it necessary to attach powerful pulling devices that are securely clamped to the bodies and frames comprising:

(a) an elongated bar including a clamping portion and an anchoring portion and a plurality of threaded bolts, (b) the clamping portion comprising a generally rectangular cross-section with opposing flat sides connected by opposing edges, the flat sides having a plurality of threaded holes constructed to receive a plurality of threaded bolts, the threaded holes being in space relation one to the next and aligned with the longitudinal axis of elongation of the bar, (c) the anchor portion including means to anchor the pulling devices, and (d) a plurality of threaded bolts being constructed to threadly match the plurality of threaded holes.

5. The system according the claim 4 wherein the anchor means is an aperture in the form of an enlarged section and a slotted section, and the pulling devices are a chain constructed to pass through the enlarged section and anchor in the slotted section.

6. The system according to claim 4 wherein the following is included:

(e) a plurality of angled auxiliary bars constructed to fit between the bolts and the clamping bar on one angled side and to be bolted to the body or the frame on the other angled side.

* * * * *